US008486599B2

(12) United States Patent
Kuroyama

(10) Patent No.: US 8,486,599 B2
(45) Date of Patent: Jul. 16, 2013

(54) DEVELOPER AND IMAGE FORMING APPARATUS

(75) Inventor: Koichi Kuroyama, Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/605,062

(22) Filed: Sep. 6, 2012

(65) Prior Publication Data

US 2013/0071783 A1 Mar. 21, 2013

Related U.S. Application Data

(60) Provisional application No. 61/536,773, filed on Sep. 20, 2011.

(51) Int. Cl.
*G03G 9/087* (2006.01)

(52) U.S. Cl.
USPC ..... 430/109.4; 430/108.4; 399/222

(58) Field of Classification Search
USPC ..... 430/108.4, 109.4; 399/222
See application file for complete search history.

(56) References Cited

U.S. PATENT DOCUMENTS

| | | | | |
|---|---|---|---|---|
| 6,713,221 | B2 | 3/2004 | Kada et al. | |
| 7,379,696 | B2 | 5/2008 | Sawada et al. | |
| 2003/0180641 | A1 * | 9/2003 | Nakajima et al. | 430/108.1 |
| 2003/0224278 | A1 | 12/2003 | Shirai et al. | |
| 2010/0330486 | A1 * | 12/2010 | Zhou et al. | 430/108.4 |

FOREIGN PATENT DOCUMENTS

| | | |
|---|---|---|
| JP | 3287733 | 3/2002 |

* cited by examiner

*Primary Examiner* — Peter Vajda
(74) *Attorney, Agent, or Firm* — Turocy & Watson, LLP

(57) ABSTRACT

According to an embodiment, provided is a developer, which is used for a full-color image forming apparatus, wherein the developer includes a monochrome toner and a color toner, each including a coloring material, an amorphous polyester resin, a crystalline polyester resin, and an ester wax which includes ester compounds having an alkyl group and also having a carbon number of from 32 to 48, the amorphous polyester resin to be blended in the monochrome toner has a melting point (Tm2) of from 140 to 155° C. and the amorphous polyester resin to be blended in the color toner has a melting point (Tm1) of from 115 to 130° C., and the Tm1 and the Tm2 satisfy the following formula (1): 10(° C.)≦Tm2−Tm1≦40(° C.).

20 Claims, 1 Drawing Sheet

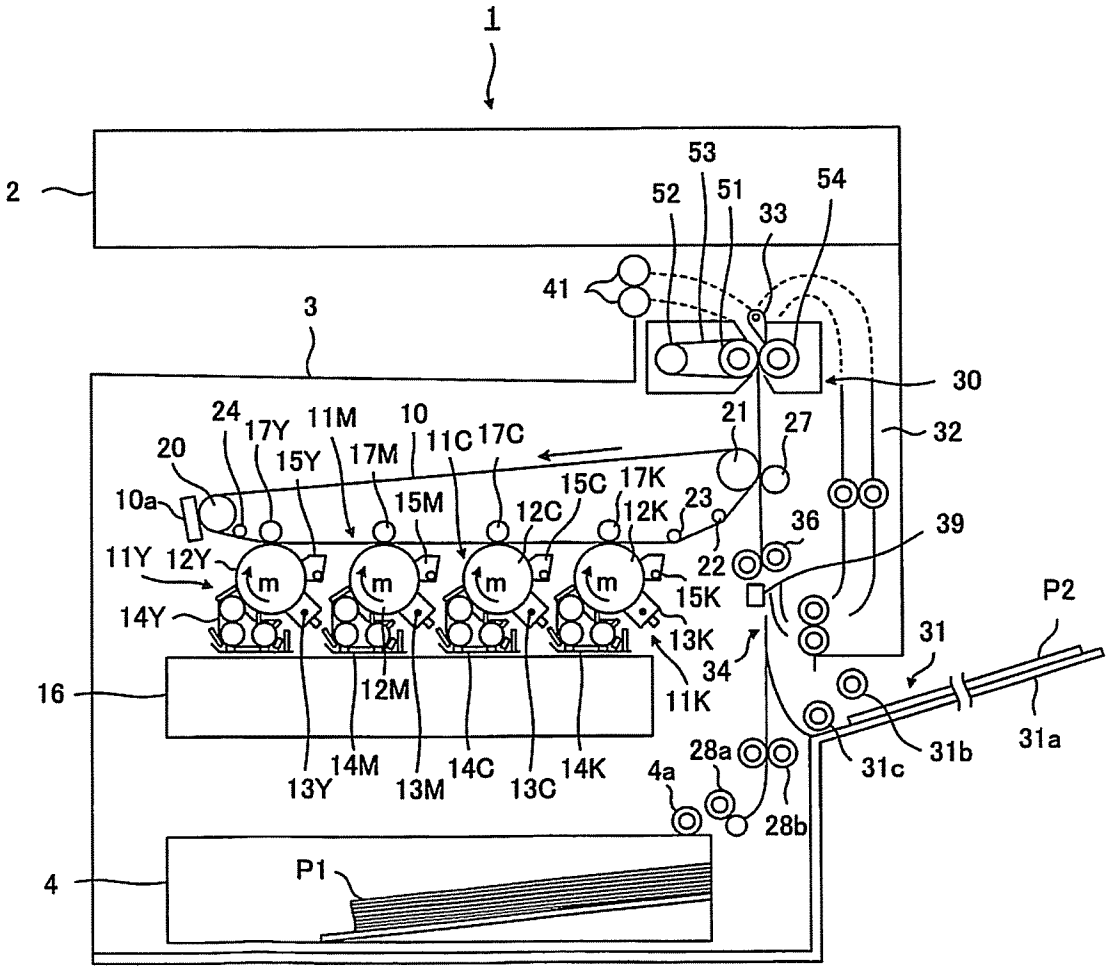
1
2
3
4
4a
10
10a
11C
11K
11M
11Y
12C
12K
12M
12Y
13C
13K
13M
13Y
14C
14K
14M
14Y
15C
15K
15M
15Y
16
17C
17K
17M
17Y
20
21
22
23
24
27
28a
28b
30
31
31a
31b
31c
32
33
34
36
39
41
51
52
53
54
P1
P2

DEVELOPER AND IMAGE FORMING APPARATUS

CROSS-REFERENCE TO RELATED APPLICATION

This application is based upon and claims the benefit of priority from provisional U.S. Patent Application 61/536,773 filed on Sep. 20, 2011, the entire contents of which are incorporated herein by reference.

FIELD

Embodiments described herein relate generally to a full-color developer.

BACKGROUND

In recent years, for the purpose of saving energy in an electrophotographic technique, a reduction in power consumption of a fixing device which consumes a lot of electricity is progressing, and therefore, also a toner is required to be fixed at a lower temperature.

In offices, while high-gloss and clear full-color images such as posters, advertisements and photos are demanded, a demand for low-gloss images in a monochrome mode is high because if a high-gloss image is formed in the case of a monochrome image such as a document or a slip, light is reflected much in a character part and the characters are less easy to read. In this manner, demands for gloss in the cases of full-color images and monochrome images to be output from an image forming apparatus adaptable to full color are contradictory to each other, and a toner satisfying such contradictory demands is demanded.

BRIEF DESCRIPTION OF THE DRAWINGS

The accompanying drawing, which is incorporated in and constitutes a part of this specification, illustrates an embodiment of the invention and together with the description, serves to explain the principles of the invention.

The FIG. 1 is an exemplary view showing an image forming apparatus according to an embodiment.

DETAILED DESCRIPTION

Reference will now be made in detail to the present embodiment of the invention, an example of which is illustrated in the accompanying drawing.

According to the present embodiment, provided is a developer, including a color toner containing a coloring material, an amorphous polyester resin having a melting point (Tm1) of from 115 to 130° C., a crystalline polyester resin, and an ester wax which includes ester compounds having an alkyl group and also having a carbon number of from 32 to 48 and a monochrome toner containing a coloring material, an amorphous polyester resin having a melting point (Tm2) of from 140 to 155° C., a crystalline polyester resin, and an ester wax which includes ester compounds having an alkyl group and also having a carbon number of from 32 to 48, wherein the Tm1 and the Tm2 satisfy the following formula (I).

$$10(^\circ\,\mathrm{C.}) \leqq Tm2 - Tm1 \leqq 40(^\circ\,\mathrm{C.}) \quad (1)$$

Further, according to the present embodiment, provided is an image forming apparatus, which is capable of outputting a monochrome image and a color image and including an image carrier on which an image to be transferred to a transfer medium is formed by supplying a toner to an electrostatic latent image to develop the electrostatic latent image, wherein the toner includes a monochrome toner and a color toner, each including toner particles containing a coloring material, an amorphous polyester resin, a crystalline polyester resin, and an ester wax which includes ester compounds having an alkyl group and also having a carbon number of from 32 to 48, and an additive including an inorganic oxide to be added to the surfaces of the toner particles, the amorphous polyester resin to be used for the monochrome toner has a melting point (Tm2) of from 140 to 155° C. and the amorphous polyester resin to be used for the color toner has a melting point (Tm1) of from 115 to 130° C., and the Tm1 and the Tm2 satisfy the following formula (1).

$$10(^\circ\,\mathrm{C.}) \leqq Tm2 - Tm1 \leqq 40(^\circ\,\mathrm{C.}) \quad (1)$$

According to the present embodiment, low-temperature fixing is achieved and also the contradictory demands for images such that a clear and high-gloss image is demanded for a full-color mode and a low-gloss image which enables easy reading of characters and the like is demanded for a monochrome mode can be achieved.

By using the ester wax having the above-described characteristics, a toner, in which the wax is favorably dispersed and which has favorable high-temperature storage stability, is obtained. Further, by using the crystalline polyester resin in combination with this ester wax, Tg of the toner is significantly decreased, and therefore, it is possible to improve a low-temperature offset property. Accordingly, the toner is instantaneously melted and solidified when fixing, and therefore, the surface becomes smooth and the gloss is increased, and in a color mode, which is often used for photos or the like, a clear image is formed. Further, by setting the melting point (Tm2) of a binder resin to be used for a black toner and the melting point (Tm1) of a binder resin to be used for a color toner such that the Tm1 and the Tm2 satisfy the above-described relationship, a low-gloss image is formed in a monochrome mode, and therefore, in the case of an image having a lot of characters, etc. such as documents and slips, an image in which light is less reflected in a character part and the characters are easy to read is formed.

Hereinafter, the present embodiment will be more specifically described.

As the binder resin to be used in the embodiment, an amorphous polyester resin is used. In order to achieve the contradictory demands for a full-color image and a monochrome image, the melting point (Tm2) of the resin to be blended in a black toner is set higher than the melting point (Tm1) of the resin to be blended in a color toner. From the viewpoint of low-temperature fixing, the melting point (Tm1) of the resin to be blended in the color toner is set to 115 to 130° C., and the melting point (Tm2) of the resin to be blended in the black toner is set to 140 to 155° C. A difference (Tm2−Tm1) in the melting point between the resin to be blended in the black toner and the resin to be blended in the color toner is preferably from 10 to 40° C. If the difference in the melting point is less than 10° C., a black image becomes a high-gloss image, and there is not so much difference in gloss between the black image and the color image. On the other hand, if the difference in the melting point is more than 40° C., the low-temperature fixing of the black toner is deteriorated.

As raw material monomers of the amorphous polyester resin which are used in the embodiment, for example, a dihydric or polyhydric alcohol component and a divalent or polyvalent carboxylic acid component such as carboxylic acids, carboxylic acid anhydrides and carboxylic acid esters are used.

Examples of the dihydric alcohol component include alkylene oxide adducts of bisphenol A such as polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene(2.0)-2,2-bis(4-hydroxyphenyl) propane and polyoxypropylene(6)-2,2-bis(4-hydrxoyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

Among the dihydric alcohol component, bisphenol A-alkylene (carbon number: 2 or 3) oxide adducts (average addition molar number: 1 to 10), ethylene glycol, propylene glycol, 1,6-hexanediol, bisphenol A, hydrogenated bisphenol A and the like are preferable.

Examples of the trihydric or polyhydric alcohol component can include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

Among the trihydric or polyhydric alcohol component, sorbitol, 1,4-sorbitan, pentaerythritol, glycerol, trimethylolethane and the like are preferable.

The dihydric, trihydric or polyhydric alcohol component may be used either singly or in combination of two or more.

Examples of the divalent carboxylic acid component include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkenyl succinates such as n-dodecenyl succinate, alkyl succinates such as n-dodecyl succinate, and anhydrides or lower alkyl esters of these acids.

Among the divalent carboxylic acid component, maleic acid, fumaric acid, terephthalic acid, a succinic acid substituted with an alkenyl group having a carbon number of from 2 to 20 and the like are preferable.

Examples of the trivalent or polyvalent carboxylic acid component can include 1,2,4-benzenetricarboxylic acid(trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, empole trimer acid, and anhydrides or lower alkyl(carbon number: 1 to 12) esters of these acids.

Among the trivalent or polyvalent carboxylic acid component, 1,2,4-benzenetricarboxylic acid(trimellitic acid), an acid anhydride or alkyl (carbon number: 1 to 12) ester thereof, and the like are preferable.

The divalent, trivalent or polyvalent carboxylic acid component may be used either singly or in combination of two or more.

In polymerizing the raw material monomers of the polyester, in order to promote the reaction, a catalyst which is usually used, such as dibutyltin oxide, a titanium compound, a dialkoxytin(II), tin(II) oxide, a fatty acid tin(II), tin(II) dioctanoate and tin(II) distearate, may be properly used.

As the acid component serving as the raw material monomer of the crystalline polyester resin which is used in the embodiment, for example, adipic acid, oxalic acid, malonic acid, maleic acid, fumaric acid, citraconic acid, itaconic acid, glutaconic acid, succinic acid, phthalic acid, isophthalic acid, terephthalic acid, sebacic acid, azelaic acid, n-dodecyl succinic acid, n-dodecenyl succinic acid, cyclohexane dicarboxylic acid, trimellitic acid, pyromellitic acid, and an acid anhydride thereof, a C1-3 alkyl ester thereof, and the like can be exemplified, and among these, fumaric acid is preferable.

Further, examples of the alcohol component include ethylene glycol, 1,2-propylene glycol, 1,3-propylene glycol, 1,4-butanediol, 1,5-pentanediol, 1,6-hexanediol, neopentyl glycol, 1,4-butenediol, polyoxypropylene, polyoxyethylene, glycerin, pentaerythritol, and trimethylolpropane, and among these, 1,4-butanediol, 1,6-hexanediol, and the like are preferable.

The addition amount of the crystalline polyester resin in the toner particles is preferably from 3 to 35% by weight. If the addition amount thereof is less than 3% by weight, the low-temperature offset resistance tends to be deteriorated, and if the addition amount thereof exceeds 35% by weight, the storage stability in a high temperature environment tends to be deteriorated. The addition amount thereof is more preferably from 5 to 20% by weight.

Incidentally, in the embodiment, a polyester resin having a ratio of a softening point to a melting temperature (softening point/melting temperature) of from 0.9 to 1.1 is referred to as the crystalline polyester resin.

As the ester wax to be used in the embodiment, an ester wax composed of ester compounds having an alkyl group and also having a carbon number of from 32 to 48 is used. In particular, an ester wax in which an ester compound having a carbon number showing a maximum intensity ratio when an ion intensity ratio at each mass number (carbon number) in a mass analysis is expressed in terms of percentage is contained in an amount of from 20 to 55% by weight of the total amount of the ester wax, and an ester compound having a carbon number of 38 or less is contained in an amount of less than 10% by weight of the total amount of the ester wax is preferable.

In general, when the ester wax is used, the high-temperature offset resistance is enhanced, however, if a long straight chain ester wax is used, the ester wax can be less easily dispersed finely in the toner, and therefore, the dispersion diameter of the wax in the toner becomes large, and the wax is deposited from the surface of the toner when the toner is stored at a high temperature. In view of this, by using the ester wax of the embodiment, a toner, in which the wax is favorably dispersed, and which has favorable high-temperature storage stability, is obtained. Further, when the ester wax of the embodiment and the above-described crystalline polyester resin are used in combination, the Tg of the toner is significantly decreased, and therefore, it is possible to improve the low-temperature offset property.

As raw materials of the ester wax to be used in the embodiment, a long-chain alkyl carboxylic acid component having a carbon number of from 16 to 24 and a long-chain alkyl alcohol component having a carbon number of from 16 to 24 are used. The ester wax can be prepared by selecting the types of these components and adjusting the blending amounts thereof and performing an esterification reaction.

The addition amount of the ester wax to be used in the embodiment can be set to 3 to 17% by weight in the toner particles. If the addition amount thereof is less than 3% by weight, the high-temperature offset resistance tends to be deteriorated, and if the addition amount thereof exceeds 17% by weight, the toner tends to adhere to an image carrier or the storage stability in a high temperature environment tends to be deteriorated.

As the coloring agent, carbon black or organic or inorganic pigments or dyes which are used for the color toner application can be used. In the embodiment, examples of the carbon black include acetylene black, furnace black, thermal black, channel black and ketjen black; and examples of the pigment or dye include Fast Yellow G, Benzidine Yellow, Indo Fast Orange, Irgazin Red, Carmine FB, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green and quinacridone. These materials can be used singly or in admixture. The addition amount of the coloring agent can be, for example, from 4 to 10 parts by weight based on 100 parts by weight of the binder resin. The addition amount of the coloring agent can be, for example, from 4 to 10 parts by weight based on 100 parts by weight of the binder resin.

As the charge controlling agent, for example, a metal-containing azo compound is useful. Complexes or complex salts in which a metal element of the metal-containing azo compound is selected from iron, cobalt and chromium, or mixtures thereof can be used. Also, a metal-containing salicylic acid derivative compound or a metal oxide hydrophobilized material is useful. Complexes or complex salts in which a metal element thereof is selected from zirconium, zinc and chromium, or mixtures thereof; and complexes or complex salts of such a metal and boron, or mixtures thereof are desirable. A clathrate compound of polysaccharide containing aluminum and magnesium can be used. The addition amount of the charge controlling agent can be, for example, from 0.5 to 2 parts by weight based on the 100 parts by weight of the binder resin.

The toner is prepared by mixing and dispersing these materials. As an apparatus for mixing the toner particle material, for example, a Henschel mixer (manufactured by Mitsui Mining Company, Limited.); a super mixer (manufactured by Kawata Mfg., Co., Ltd.); Ribocone (manufactured by Okawara Mfg., Co., Ltd.); a nauta mixer, a turbulizer and a cyclomixer (all of which are manufactured by Hosokawa Micron Corporation); a spiral pin mixer (manufactured by Pacific Machinery & Engineering Co., Ltd.); and a Lodige mixer (manufactured by Matsubo Corporation). Examples of a kneader include a KRC kneader (manufactured by Kurimoto, Ltd.); a Buss Ko-kneader (manufactured by Buss); a TEM type extruder (manufactured by Toshiba Machine Co., Ltd.); a TEX two-screw kneader (manufactured by The Japan Steel Works, Ltd.); a PCM kneader (manufactured by Ikegai, Ltd.); a three-roll mill, a mixing roll mill and a kneader (all of which are manufactured by Inoue Mfg., Inc.); Kneadex (manufactured by Mitsui Mining Company, Limited.); an MS type pressure kneader, a kneader-ruder (manufactured by Moriyama Company Ltd.); and a Banbury mixer (manufactured by Kobe Steel, Ltd.).

Also, as an apparatus for coarsely pulverizing the mixture, for example, a hammer mill, a cutter mill, a jet mill, a roller mill, a ball mill, etc. can be used. Also, examples of an apparatus for finely pulverizing the coarsely pulverized material include a counterjet mill, Micronjet and Inomizer (all of which are manufactured by Hosokawa Micron Corporation); an IDS type mill and a PJM jet pulverizer (all of which are manufactured by Nippon Pneumatic Mfg. Co., Ltd.); Crossjet Mill (manufactured by Kurimoto, Ltd.); Ulmax (manufactured by Nisso Engineering Co., Ltd.); SK Jet-O-Mill (manufactured by Seisin Enterprise Co., Ltd.); Cliptron (manufactured by Kawasaki Heavy Industries, Ltd.); and Turbo Mill (manufactured by Turbo Kogyo Co., Ltd.).

Also, examples of a classifier for classifying the finely pulverized material include Classiel, Micron Classifier and Spedic Classifier (all of which are manufactured by Seisin Enterprises Co., Ltd.); Turbo Classifier (manufactured by Nisshin Engineering Co., Ltd.); Micron separator, Turboplex (ATP) and TSP Separator (all of which are manufactured by Hosokawa Micron Corporation); Elbow-Jet (manufactured by Nittetsu Mining Co., Ltd.); Dispersion Separator (manufactured by Nippon Pneumatic Mfg. Co., Ltd.); and YM Microcut (manufactured by Yasukawa Shoji K.K.).

In order to adjust the fluidity and the chargeability of the toner, an additive composed of inorganic oxide particles having an average particle diameter of less than 80 nm can be added to the surface of the toner.

Further, in order to maintain the charging property, it is preferable that along with the above-described inorganic oxide fine particles, inorganic oxide particles having an average particle diameter of from 80 nm to 200 nm are added. If the average particle diameter thereof is less than 80 nm, the transferring efficiency of the toner to a transfer belt or paper is deteriorated, and on the other hand, if the average particle diameter thereof exceeds 200 nm, the inorganic oxide particles may damage a photoconductor. In the embodiment, for the purpose of maintaining the charging property of the toner, the additive can be added to the surfaces of the toner particles.

Examples of such an additive include silica, titania, alumina, strontium titanate, and tin oxide. At least two or more types of inorganic oxide fine particles having different average primary particle diameters can be mixed and used. As these inorganic oxide fine particles, those surface-treated with a hydrophobizing agent can be used from the viewpoint of improvement of environmental stability.

Further, other than such inorganic oxide fine particles, resin fine particles having an average particle diameter of 1 μm or less can be added.

As an apparatus for mixing the additives, the foregoing mixing machine is useful.

Examples of a screening apparatus for sieving coarse particles or the like include Ultra Sonic (manufactured by Koei Sangyo Co., Ltd.); Resona Sieve and Gyroshifter (all of which are manufactured by Tokuju Corporation); Vibrasonic System (manufactured by Dalton Co., Ltd.); Soniclean (manufactured by Shinto Kogyo Kabushiki Kaisha); Turbo-screener (manufactured by Turbo Kogyo Co., Ltd.); Micro-shifter (manufactured by Makino Mfg. Co., Ltd.); and a circular vibrating separator.

Such a developer is used for, for example, an image forming apparatus as described below.

A diagrammatic view showing an example of an image forming apparatus to which the developing agent according to the embodiment is applicable is shown in the FIGURE.

As shown in the FIGURE, a scanner section 2 and a paper discharge section 3 are provided in an upper portion of a color copier, MFP (e-studio 4520c) 1 of a quadruple tandem system.

The color copier 1 has image forming stations 11Y, 11M, 11C and 11K of four groups of yellow (Y), magenta (M), cyan (C) and black (K) disposed in parallel along a lower side of an intermediate transfer belt (intermediate transfer medium) 10.

The respective image forming stations 11Y, 11M, 11C and 11K have photoreceptor drums (image carriers) 12Y, 12M, 12C and 12K, respectively. In the surroundings of the photoreceptor drums 12Y, 12M, 12C and 12K, electrification chargers 13Y, 13M, 13C and 13K; development apparatuses 14Y, 14M, 14C and 14K; and photoreceptor cleaning apparatuses 15Y, 15M, 15C and 15K are disposed along the rotation direction shown by an arrow m direction.

On the way from the electrification chargers 13Y, 13M, 13C and 13K to the development apparatuses 14Y, 14M, 14C and 14K in the surroundings of the photoreceptor drums 12Y, 12M, 12C and 12K, laser light is applied by a laser exposure apparatus (latent image forming apparatus) 16, an electrostatic latent image is formed on the photoreceptor drums 12Y, 12M, 12C and 12K.

Each of the development apparatuses 14Y, 14M, 14C and 14K has a two-component developing agent composed of each of yellow (Y), magenta (M), cyan (C) and black (K) toners and a carrier, respectively and feeds the toner to the electrostatic latent image on the photoreceptor drums 12Y, 12M, 12C and 12K, respectively.

The intermediate transfer belt 10 is hung by a backup roller 21, a driven roller 20 and first to third tension rollers 22 to 24. The intermediate transfer belt 10 is opposed to and brought into contact with the photoreceptor drums 12Y, 12M, 12C and 12K. Primary transfer rollers 17Y, 17M, 17C and 17K for primarily transferring the toner images on the photoreceptor drums 12Y, 12M, 12C and 12K onto the intermediate transfer belt 10 are provided at positions of the intermediate transfer belt 10 opposing the photoreceptor drums 12Y, 12M, 12C and 12K, respectively. Each of these primary transfer rollers 17Y, 17M, 17C and 17K is a conductive roller, and a primary transfer bias voltage is impressed in each of these primary transfer sections.

A secondary roller 27 is disposed in a secondary transfer section which is a transfer position of the intermediate transfer belt 10 supported by the backup roller 21. In the secondary transfer section, the backup roller 21 is a conductive roller, and a prescribed secondary transfer bias is impressed thereto. When a sheet paper (a final transfer medium) which is an object to printing passes between the intermediate transfer belt 10 and the secondary transfer roller 27, the toner image on the intermediate transfer belt 10 is secondarily transferred onto the sheet paper. After completion of the secondary transfer, the intermediate transfer belt 10 is cleaned up by a belt cleaner 10*a*.

A paper feed cassette 4 for feeding a sheet paper P1 toward the direction of the secondary transfer roller 27 is provided in a lower portion of the laser exposure apparatus 16. A manual-bypass mechanism 31 for manually feeding a sheet paper P2 is provided on the right side of the color copier 1. On the way from the paper feed cassette 4 to the secondary transfer roller 27, a pickup roller 4*a*, a separation roller 28*a*, a carrying roller 28*b* and a resist roller pair 36 are provided, thereby constituting a paper feed mechanism.

On the way from a manual-bypass tray 31*a* of the manual-bypass mechanism 31 to the resist roller pair 36, a manual-bypass pickup roller 31*b* and a manual-bypass separation roller 31*c* are provided. Furthermore, a medium sensor 39 for detecting the kind of sheet paper is disposed on a vertical carrying route 34 for carrying the sheet paper from the paper feed cassette 4 or the manual-bypass tray 31*a* toward the direction of the secondary transfer roller 27. The color copier 1 is able to control a carrying rate of sheet paper, a transfer condition, a fixing condition and so on from the detection results by the medium sensor 39. Also, a fuser unit 30 is provided in the downstream of the secondary transfer section along the direction of the vertical carrying route 34. The sheet paper taken out from the paper feed cassette 4 or fed from the manual-bypass mechanism 31 is carried into the fuser units 30 through the resist roller pair 36 and the secondary transfer roller 27 along the vertical carrying route 34.

The fuser units 30 has a fuser units 53 wound around a pair of a heating roller 51 and a driving roller 52 and a counter roller 54 disposed opposing the heating roller 51 via the fuser units 53. The sheet paper having a toner image transferred in the secondary transfer section is introduced between the fuser units 53 and the counter roller 54, and the toner image transferred onto the sheet paper is heat treated and fixed upon heating by the heating roller 51. A gate 33 is provided in the downstream of the fuser units 30, whereby the sheet paper is distributed into the direction of a paper discharge roller 41 and the direction of a recarrying unit 32. The sheet paper introduced into the paper discharge roller 41 is discharged into the paper discharge section 3. Also, the sheet paper introduced into the recarrying unit 32 is again introduced onto the direction of the secondary transfer roller 27.

The image forming station 11Y has the photoreceptor drum 12Y and a process measure in an integral manner and is provided in a detachable manner relative to a main body of the image forming apparatus. The process measure as referred to herein means at least one of the electrification charger 13Y, the development apparatus 14Y and the photoreceptor cleaning apparatus 15Y. Each of the image forming stations 11M, 11C and 11K has the same configuration as the image forming station 11Y. Each of the image forming stations 11Y, 11M, 11C and 11K may be detachable relative to the image forming apparatus or may be detachable as the integrated image forming unit 11 relative to the image forming apparatus.

Examples are hereunder shown, and the embodiments are more specifically described.

[1] Ester Wax

Preparation Example of Ester Wax

In a four-necked flask equipped with a stirrer, a thermocouple and a nitrogen introducing pipe, 80 parts by weight of a long-chain alkyl carboxylic acid component and 20 parts by weight of a long-chain alkyl alcohol component were charged and subjected to an esterification reaction at 220° C. in a nitrogen gas stream. The obtained reaction product was diluted with a mixed solvent of toluene and ethanol, to which was then added a sodium hydroxide aqueous solution, and the mixture was stirred at 70° C. for 30 minutes. Thereafter, the reaction mixture was allowed to stand for 30 minutes, thereby removing an aqueous layer. Furthermore, an operation of adding ion exchanged water, stirring the mixture at 70° C. for 30 minutes and then allowing the reaction mixture to stand for 30 minutes, thereby removing an aqueous layer was repeated five times. The solvent was distilled off from the obtained organic layer (ester layer) under a reduced pressure condition, thereby obtaining Ester Wax. A structural formula showing an example of the ester wax is expressed by the following chemical formula (1).

$$CH3(CH2)nCOO(CH2)mCH3 \quad (1)$$

In the chemical formula (1), each of n and m represents a constant.

Each ester wax was prepared by changing the types and amounts of the long-chain alkyl carboxylic acids and the types and amounts of the long-chain alkyl alcohols shown in Table 1. In particular, when the distribution of carbon number is widened, preparation was carried out by using plural types of the long-chain alkyl carboxylic acid components and plural types of the long-chain alkyl alcohol components.

TABLE 1

| Long-chain alkyl carboxylic acid component | | Long-chain alkyl alcohol component | |
|---|---|---|---|
| palmitic acid | ($C_{16}H_{32}O_2$) | palmityl alcohol | ($C_{18}H_{34}O$) |
| stearic acid | ($C_{18}H_{36}O_2$) | stearyl alcohol | ($C_{18}H_{38}O$) |
| arachidic acid | ($C_{20}H_{40}O_2$) | arachidyl alcohol | ($C_{20}H_{42}O$) |
| behenic acid | ($C_{22}H_{44}O_2$) | behenyl alcohol | ($C_{22}H_{46}O$) |
| lignoceric acid | ($C_{24}H_{48}O_2$) | lignoceryl alcohol | ($C_{24}H_{48}O$) |

The melting point of the obtained ester wax was measured by using a differential scanning calorimeter (DSC) "DSC Q2000" (manufactured by TA Instruments, Inc.).

The measurement was carried out under the following conditions: Sample: 5 mg, Lid and pan: Alumina, Temperature raising rate: 10° C./min, and Measurement temperature: 20 to 200° C. A data obtained by the measurement by heating the sample to 200° C., followed by cooling the sample to 20° C. or lower and again heating the sample under the same conditions was employed, and a maximum endothermic peak generated at from around 60° C. to around 80° C. was defined as the melting point of the wax.

Further, a mass analysis of the obtained ester wax was carried out by using FD/MS (JMS-T100GC, manufactured by JEOL Ltd.).

The measurement was carried out under the following conditions: Sample: 1 mg (dissolved in 1 mL of chloroform), Cathode voltage: −10 kV, Spectrum recording interval: 0.4 seconds, and Measuring mass range: m/z 10 to 2000. The intensities of the respective carbon numbers of the ester compounds were summed and the sum was taken as 100%, and a relative intensity of each carbon number was calculated, thereby confirming the maximum intensity.

Incidentally, with respect to an ester wax (H) as which rice wax was used, C54 was defined as the maximum intensity.

Further, the acid value and hydroxyl value of the obtained ester wax were measured according to JIS K0070.

The data of ester waxes A, B, and C of the embodiment are shown in Table 2.

TABLE 2

| | Content ratio of ester compound (%) | | | | | | | | | melting point | Acid value | Hydroxyl value |
|---|---|---|---|---|---|---|---|---|---|---|---|---|
| Wax | C32 | C34 | C36 | C38 | C40 | C42 | C44 | C46 | C48 | (° C.) | (mgKOH/g) | (mgKOH/g) |
| A | 0 | 0 | 2.3 | 3.1 | 13.8 | 27 | 44.7 | 3.7 | 5.4 | 68 | 0.1 | 0.5 |
| B | 0 | 0 | 0 | 2.5 | 18.5 | 15.4 | 55 | 8.6 | 0 | 74 | 0.1 | 0.4 |
| C | 0 | 0 | 6 | 3.2 | 22.4 | 22.1 | 22 | 18.9 | 5.4 | 61 | 0.1 | 0.4 |

Preparation of Comparative Ester Wax (D)

By increasing the blending amounts of behenic acid and behenyl alcohol, a comparative ester wax (D) in which the ester compound having a carbon number showing the maximum intensity among the ester compounds having a carbon number of from 32 to 48 accounts for 60% or more of the total amount of the wax was prepared. The data of the comparative ester wax (D) is shown in Table 3.

Preparation of Comparative Ester Wax (E)

By increasing the blending amounts of stearic acid and stearyl alcohol, a comparative ester wax (E) in which the ester compounds having a carbon number of 38 or less account for 10% or more of the total amount of the wax was prepared. The data of the comparative ester wax (E) is shown in Table 3.

Preparation of Comparative Ester Wax (F)

By increasing the blending amounts of stearic acid and stearyl alcohol, a comparative ester wax (F) in which the ester compound having a carbon number of 40 accounts for less than 20% of the total amount of the wax was prepared. The data of the comparative ester wax (F) is shown in Table 3.

Preparation of Comparative Ester Wax (G)

By using only palmitic acid and palmityl alcohol, a comparative ester wax (G) was prepared. The data of the comparative ester wax (G) is shown in Table 3.

TABLE 3

| | Content ratio of ester compound (%) | | | | | | | | | melting point | Acid value | Hydroxyl value |
|---|---|---|---|---|---|---|---|---|---|---|---|---|
| Wax | C32 | C34 | C36 | C38 | C40 | C42 | C44 | C46 | C48 | (° C.) | (mgKOH/g) | (mgKOH/g) |
| D | 0 | 0 | 0 | 0.5 | 6.2 | 16.4 | 73 | 1 | 2.9 | 76 | 0.1 | 0.5 |
| E | 0 | 0 | 5.3 | 6.8 | 13.8 | 27 | 40 | 2.7 | 4.4 | 65 | 0.1 | 0.5 |
| F | 0 | 5.4 | 14.7 | 13.9 | 18.7 | 9.5 | 17.8 | 13.6 | 6.4 | 63 | 0.1 | 0.3 |
| G | 100 | 0 | 0 | 0 | 0 | 0 | 0 | 0 | 0 | 59 | 0.1 | 0.4 |

Comparative Ester Wax (H)

As a comparative ester wax (H), rice wax was used. The data of the comparative ester wax (H) is shown in Table 4.

TABLE 4

| | Content ratio of ester compound (%) | | | | | | | | | melting point | Acid value | Hydroxyl value |
|---|---|---|---|---|---|---|---|---|---|---|---|---|
| Wax | C46 | C48 | C50 | C52 | C54 | C56 | C58 | C60 | C62 | (° C.) | (mgKOH/g) | (mgKOH/g) |
| H | 7 | 12 | 13 | 18 | 20 | 15 | 10 | 5 | 0 | 79 | 6.3 | 15.4 |

[2] Preparation of Developer and Evaluation

Evaluation Items:

Evaluation of Fixing Offset

By modifying a fixing system of commercially available e-studio 6530c (manufactured by Toshiba Tec Corporation), the fixing temperature was set to 130° C., and a solid image with a toner deposition amount of 1.6 mg/cm$^2$ was printed on 10 sheets by using the modified e-studio 6530c. In those ten sheets, a case where the image was not even slightly peeled off (poor fixing) due to offset or unfixing was evaluated as "Good" and a case where the image was peeled off was evaluated as "Bad".

Evaluation of Image

An original document with an entirely solid image was copied on an A4 sheet by using commercially available e-studio 6530c (manufactured by Toshiba Tec Corporation), and the image was measured by using Gloss Checker TMS-724 (manufactured by TASCO Co., Ltd.). When the measurements satisfied the following requirements, the developer was determined to be acceptable.

The gloss of the entirely solid image copied in a monochrome mode is 10 or less.

The gloss of the entirely solid image copied in a color mode is 20 or more.

Hereinafter, with respect to the developers of Examples 1 to 11 and Comparative Examples 1 to 7, the evaluation of fixing offset and the evaluation of image were performed according to the above-described evaluation methods. Further, wax components were extracted from each toner, and a mass analysis and the measurement of a melting point were performed. The results are shown in Table 5.

Example 1

Polyester resin (binder): 80 parts by weight

Crystalline polyester resin: 10 parts by weight

Ester wax (A): 3 parts by weight

Coloring agent (MA-100): 6 parts by weight

Charge control agent (a polysaccharide compound containing Al and Mg): 1 part by weight A resin (binder) having a melting point (Tm1) of 116° C. was used for a color toner and a resin (binder) having a melting point (Tm2) of 141° C. was used for a monochrome toner. Such a resin and the other materials were mixed in a Henschel mixer, and the resulting mixture was melt-kneaded by a twin-screw extruder. The obtained melt-kneaded material was cooled and then coarsely pulverized by a hammer mill. Subsequently, the coarsely pulverized material was finely pulverized by a jet pulverizer and classified, thereby obtaining a powder having a volume average particle diameter of 7 μm. A difference in Tm (Tm2−Tm1) between these resins was 25° C.

To 100 parts by weight of this powder, the following additives were added and mixed in a Henschel mixer, thereby preparing a color toner and a monochrome toner.

Additives:

Monodispersed inorganic fine particle compound having an average primary particle diameter of 82 nm, hydrophobic silica: 0.8 parts by weight Hydrophobic silica having an average primary particle diameter of 30 nm: 1 part by weight Hydrophobic titanium oxide having an average primary particle diameter of 20 nm: 0.5 parts by weight The obtained toner was mixed in an amount of 6 parts by weight with respect to 100 parts by weight of a silicone resin-surface coated ferrite carrier having an average particle diameter of 40 μm in a tabular mixer by stirring, thereby obtaining a developer.

Incidentally, in the measurement of the melting point (Tm) of the resin, a Koka-type flow tester (CFT-500D; manufactured by Shimadzu Corporation) was used.

After setting a die, 1 g of a sample was placed on the die. By using a die having a pore size of 1 mm, the measurement was performed under the conditions of a temperature raising rate of 6° C./min and a measurement temperature of from 70 to 150° C. The temperature at a point on a flow curve corresponding to ½ of the dropping amount of a plunger was defined as the measured value based on the flowchart.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 2

A developer was prepared in the same manner as in Example 1 except that a resin (binder) having a melting point (Tm2) of 154° C. was used for a monochrome toner. Incidentally, a difference in Tm between the resins at this time was 38° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 3

A developer was prepared in the same manner as in Example 1 except that a resin (binder) having a melting point (Tm1) of 129° C. was used for a color toner and a resin (binder) having a melting point (Tm2) of 154° C. was used for a monochrome toner. Incidentally, a difference in Tm between the resins at this time was 25° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 4

A developer was prepared in the same manner as in Example 3 except that a resin (binder) having a melting point (Tm1) of 129° C. was used for a color toner and a resin (binder) having a melting point (Tm2) of 141° C. was used for a monochrome toner. Incidentally, a difference in Tm between the resins at this time was 12° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 5

A developer was prepared in the same manner as in Example 1 except that the ester wax (B) was used in place of the ester wax (A) and a resin (binder) having a melting point (Tm2) of 148° C. was used for a monochrome toner. Incidentally, a difference in Tm between the resins at this time was 32° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 6

A developer was prepared in the same manner as in Example 5 except that a resin (binder) having a melting point (Tm1) of 129° C. was used for a color toner and a resin (binder) having a melting point (Tm2) of 154° C. was used for a monochrome toner. Incidentally, a difference in Tm between the resins at this time was 25° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 7

A developer was prepared in the same manner as in Example 5 except that a resin (binder) having a melting point (Tm1) of 124° C. was used for a color toner. Incidentally, a difference in Tm between the resins at this time was 24° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 8

A developer was prepared in the same manner as in Example 1 except that the ester wax (C) was used in place of the ester wax (A), a resin (binder) having a melting point (Tm1) of 124° C. was used for a color toner, and a resin (binder) having a melting point (Tm2) of 141° C. was used for a monochrome toner. Incidentally, a difference in Tm between the resins at this time was 17° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 9

A developer was prepared in the same manner as in Example 8 except that a resin (binder) having a melting point (Tm1) of 129° C. was used for a color toner and a resin (binder) having a melting point (Tm2) of 148° C. was used for a monochrome toner. Incidentally, a difference in Tm between the resins at this time was 19° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 10

A developer was prepared in the same manner as in Example 8 except that a resin (binder) having a melting point (Tm2) of 148° C. was used for a monochrome toner. Incidentally, a difference in Tm between the resins at this time was 24° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Example 11

A developer was prepared in the same manner as in Example 8 except that a resin (binder) having a melting point (Tm1) of 121° C. was used for a color toner and a resin (binder) having a melting point (Tm2) of 154° C. was used for a monochrome toner. Incidentally, a difference in Tm between the resins at this time was 33° C.

With respect to the obtained developer, the evaluation of fixing offset and the evaluation of image were performed. As a result, it could be confirmed that offset was not caused. Further, when the gloss of an entirely solid image was measured, the measurements satisfied the determination requirements and the developer was found to be acceptable.

Comparative Example 1

A developer was prepared in the same manner as in Example 1 except that the comparative ester wax (D) was used in place of the ester wax (A), a resin (binder) having a melting point (Tm1) of 129° C. was used for a color toner, and a resin (binder) having a melting point (Tm2) of 138° C. was used for a monochrome toner. Incidentally, a difference in Tm between the resins at this time was 9° C.

With respect to the obtained developer, the evaluation of fixing offset and the evaluation of image were performed. As a result, although offset was not caused, since the melting point (Tm2) of the resin for the monochrome toner was low, the gloss was increased and the target could not be achieved, and also the reflection of light in the character part was high and the characters were less easy to read.

Comparative Example 2

A developer was prepared in the same manner as in Example 1 except that the comparative ester wax (D) was used in place of the ester wax (A), a resin (binder) having a melting point (Tm1) of 131° C. was used for a color toner, and a resin (binder) having a melting point (Tm2) of 157° C. was used for a monochrome toner. Incidentally, a difference in Tm between the resins at this time was 26° C.

With respect to the obtained developer, the evaluation of fixing offset and the evaluation of image were performed. As a result, since the melting point (Tm2) of the resin for the monochrome toner was high, offset at low temperatures was deteriorated and the target could not be achieved. Further, since the melting point (Tm1) of the resin for the color toner was also high, the gloss in the color mode was decreased and the target could not be achieved and the color photo was not clear.

Comparative Example 3

A developer was prepared in the same manner as in Example 1 except that the comparative ester wax (E) was used in place of the ester wax (A), a resin (binder) having a melting point (Tm1) of 113° C. was used for a color toner, and a resin (binder) having a melting point (Tm2) of 141° C. was used for a monochrome toner. Incidentally, a difference in Tm between the resins at this time was 28° C.

With respect to the obtained developer, the evaluation of fixing offset and the evaluation of image were performed. As a result, since the melting point (Tm1) of the resin for the color toner was low, offset at low temperatures was deteriorated and the target could not be achieved. Further, poor fixing to the sheet was caused.

Comparative Example 4

A developer was prepared in the same manner as in Example 1 except that the comparative ester wax (E) was used in place of the ester wax (A), a resin (binder) having a melting point (Tm1) of 132° C. was used for a color toner, and a resin (binder) having a melting point (Tm2) of 141° C. was used for a monochrome toner. Incidentally, a difference in Tm between the resins at this time was 9° C.

With respect to the obtained developer, the evaluation of fixing offset and the evaluation of image were performed. As a result, since the melting point (Tm1) of the resin for the color toner was high, offset at low temperatures was deteriorated and the target could not be achieved. Further, the gloss was low and the color photo was not clear.

Comparative Example 5

A developer was prepared in the same manner as in Example 1 except that the comparative ester wax (F) was used in place of the ester wax (A), a resin (binder) having a melting point (Tm1) of 116° C. was used for a color toner, and a resin (binder) having a melting point (Tm2) of 158° C. was used for a monochrome toner. Incidentally, a difference in Tm between the resins at this time was 48° C.

With respect to the obtained developer, the evaluation of fixing offset and the evaluation of image were performed. As a result, since the melting point (Tm2) of the resin for the monochrome toner was high, offset at high temperatures was deteriorated and the target could not be achieved. Further, poor fixing to sheet was caused.

Comparative Example 6

A developer was prepared in the same manner as in Example 1 except that the comparative ester wax (G) was used in place of the ester wax (A), a resin (binder) having a melting point (Tm1) of 116° C. was used for a color toner, and a resin (binder) having a melting point (Tm2) of 138° C. was used for a monochrome toner. Incidentally, a difference in Tm between the resins at this time was 22° C.

With respect to the obtained developer, the evaluation of fixing offset and the evaluation of image were performed. As a result, since the melting point (Tm2) of the resin for the monochrome toner was low, the gloss was increased, and the reflection of light in the character part was high and the characters were less easy to read.

Comparative Example 7

A developer was prepared in the same manner as in Example 1 except that the comparative ester wax (H) was used in place of the ester wax (A), a resin (binder) having a melting point (Tm1) of 129° C. was used for a color toner, and a resin (binder) having a melting point (Tm2) of 148° C. was used for a monochrome toner. Incidentally, a difference in Tm between the resins at this time was 28° C.

With respect to the obtained developer, the evaluation of fixing offset and the evaluation of image were performed. As a result, poor fixing to sheet was caused because the carbon number showing the maximum intensity was large.

TABLE 5

| | | Ester wax component extracted from toner | | | | | Tm of binder resin | | | Evaluation of fixing offset | | Evaluation of Image | |
|---|---|---|---|---|---|---|---|---|---|---|---|---|---|
| | | Wax used | Carbon number and ratio of ester compound showing maximum intensity (%) Carbon number | Ratio (%) | Ratio of ester compound having 38 carbon atoms or less (%) | Melting point (° C.) | Tm1 of Resin for color toner | Tm2 of Resin for black toner | Difference in Tm (Tm2 − Tm1) | Color mode | Monochrome mode | Image in color mode | Image in monochrome mode |
| Example | 1 | A | C44 | 44.9 | 5.4 | 68 | 116 | 141 | 25 | Good | Good | Good | Good |
| | 2 | A | C44 | 44.3 | 5.6 | 68 | 116 | 154 | 38 | Good | Good | Good | Good |
| | 3 | A | C44 | 44.5 | 5.7 | 68 | 129 | 154 | 25 | Good | Good | Good | Good |
| | 4 | A | C44 | 44.8 | 5.4 | 68 | 129 | 141 | 12 | Good | Good | Good | Good |
| | 5 | B | C44 | 54.8 | 2.8 | 74 | 116 | 148 | 32 | Good | Good | Good | Good |
| | 6 | B | C44 | 54.6 | 2.6 | 74 | 129 | 154 | 25 | Good | Good | Good | Good |
| | 7 | B | C44 | 54.5 | 2.5 | 74 | 124 | 148 | 24 | Good | Good | Good | Good |
| | 8 | C | C40 | 22 | 9.6 | 61 | 124 | 141 | 17 | Good | Good | Good | Good |
| | 9 | C | C40 | 22.6 | 9.8 | 61 | 129 | 148 | 19 | Good | Good | Good | Good |
| | 10 | C | C40 | 22.3 | 8.9 | 61 | 124 | 148 | 24 | Good | Good | Good | Good |
| | 11 | C | C40 | 22.8 | 8.6 | 61 | 121 | 154 | 33 | Good | Good | Good | Good |

TABLE 5-continued

| | | Ester wax component extracted from toner | | | | | Tm of binder resin | | | Evaluation of fixing offset | | Evaluation of Image | |
|---|---|---|---|---|---|---|---|---|---|---|---|---|---|
| | | Wax used | Carbon number and ratio of ester compound showing maximum intensity (%) Carbon number | Ratio (%) | Ratio of ester compound having 38 carbon atoms or less (%) | Melting point (° C.) | Tm1 of Resin for color toner | Tm2 of Resin for black toner | Difference in Tm (Tm2 − Tm1) | Color mode | Monochrome mode | Image in color mode | Image in monochrome mode |
| Comparative Example | 1 | D | C44 | 72.6 | 1 | 76 | 129 | 138 | 9 | Good | Good | Good | Bad |
| | 2 | D | C44 | 73.4 | 1.6 | 76 | 131 | 157 | 26 | Bad | Bad | Bad | Good |
| | 3 | E | C44 | 39.4 | 12.6 | 65 | 113 | 141 | 28 | Bad | Good | Good | Good |
| | 4 | E | G44 | 40.6 | 12.4 | 65 | 132 | 141 | 9 | Bad | Good | Bad | Good |
| | 5 | F | C40 | 19.1 | 21.6 | 63 | 116 | 158 | 42 | Good | Bad | Bad | Good |
| | 6 | G | C32 | 99.7 | 99.4 | 58 | 116 | 138 | 22 | Good | Good | Good | Bad |
| | 7 | H | C54 | 18.6 | 0 | 79 | 129 | 148 | 19 | Bad | Bad | Bad | Bad |

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions, the accompanying claims and their equivalents are intended to cover such forms or modifications as would fall within the scope and spirit of the inventions.

What is claimed is:

1. A developer, which is used for an image forming apparatus capable of outputting a full-color image and a monochrome image, comprising:

a color toner containing a coloring material, an amorphous polyester resin having a melting point (Tm1) of from 115 to 130° C., a crystalline polyester resin, and an ester wax including ester compounds having an alkyl group and also having a carbon number of from 32 to 48; and a monochrome toner containing a coloring material, an amorphous polyester resin having a melting point (Tm2) of from 140 to 155° C., a crystalline polyester resin, and an ester wax including ester compounds having an alkyl group and also having a carbon number of from 32 to 48, the Tm1 and the Tm2 satisfying the following formula (1):

$$10(^\circ\,C.) \leqq Tm2 - Tm1 \leqq 40(^\circ\,C.) \quad (1).$$

2. The developer according to claim 1, wherein in the ester wax of the color toner and the monochrome toner, the content of an ester compound showing the maximum intensity in a mass analysis is from 20 to 55% by weight, and the content of an ester compound having a carbon number of 38 or less is less than 10% by weight.

3. The developer according to claim 1, wherein the color toner and the monochrome toner each contain the ester wax having an endothermic peak temperature of from 60 to 75° C.

4. The developer according to claim 1, wherein the crystalline polyester resin is contained in toner particles in an amount of from 3 to 35% by weight.

5. The developer according to claim 1, wherein the ester wax is obtained by an esterification reaction using a carboxylic acid component having a carbon number of from 16 to 24 and an alcohol component having a carbon number of from 16 to 24.

6. The developer according to claim 5, wherein the carboxylic acid component is at least one member selected from palmitic acid, stearic acid, arachidic acid, behenic acid, and lignoceric acid.

7. The developer according to claim 5, wherein the alcohol component is at least one member selected from palmityl alcohol, stearyl alcohol, arachidyl alcohol, behenyl alcohol, and lignoceryl alcohol.

8. The developer according to claim 1, wherein the ester wax is contained in toner particles in an amount of from 3 to 17% by weight.

9. The developer according to claim 1, wherein an inorganic oxide having an average particle diameter of from 80 to 200 nm is added to the surfaces of toner particles.

10. The developer according to claim 1, wherein an additive is present being at least one member selected from silica, titania, alumina, strontium titanate, and tin oxide.

11. The developer according to claim 9, wherein an inorganic oxide having an average particle diameter of less than 80 nm is further added to the surfaces of toner particles.

12. An image forming apparatus which is capable of outputting a monochrome image and a color image comprising an image carrier, an image to be transferred to a transfer medium being formed on the image carrier by supplying a toner to an electrostatic latent image to develop the electrostatic latent image, the toner comprising a monochrome toner and a color toner, each including toner particles containing a coloring material, an amorphous polyester resin, a crystalline polyester resin, and an ester wax including ester compounds having an alkyl group and also having a carbon number of from 32 to 48, and an additive including an inorganic oxide to be added to the surfaces of the toner particles, the amorphous polyester resin to be used for the monochrome toner having a melting point (Tm2) of from 140 to 155° C. and the amorphous polyester resin to be used for the color toner having a melting point (Tm1) of from 115 to 130° C., and the Tm1 and the Tm2 satisfy the following formula (1):

$$10(^\circ\,C.) \leqq Tm2 - Tm1 \leqq 40(^\circ\,C.) \quad (1).$$

13. The apparatus according to claim 12, wherein in the ester wax of the color toner and the monochrome toner, the content of an ester compound showing the maximum intensity in a mass analysis is from 20 to 55% by weight, and the content of an ester compound having a carbon number of 38 or less is less than 10% by weight.

14. The apparatus according to claim 12, wherein the color toner and the monochrome toner each contain the ester wax having an endothermic peak temperature of from 60 to 75° C.

15. The apparatus according to claim 12, wherein the crystalline polyester resin is contained in the toner particles in an amount of from 3 to 35% by weight.

16. The apparatus according to claim 12, wherein the ester wax is obtained by an esterification reaction using a carboxylic acid component having a carbon number of from 16 to 24 and an alcohol component having a carbon number of from 16 to 24.

17. The apparatus according to claim 12, wherein the ester wax is contained in the toner particles in an amount of from 3 to 17% by weight.

18. The apparatus according to claim 12, wherein an inorganic oxide having an average particle diameter of from 80 to 200 nm is added to the surfaces of toner particles.

19. The apparatus according to claim 12, wherein an additive is present being at least one member selected from the group consisting of silica, titania, alumina, strontium titanate, and tin oxide.

20. The apparatus according to claim 18, wherein an inorganic oxide having an average particle diameter of less than 80 nm is further added to the surfaces of the toner particles.

* * * * *